US006131373A

United States Patent [19]

Cherney

[11] Patent Number: 6,131,373

[45] Date of Patent: Oct. 17, 2000

[54] VERTICAL FORM, FILL AND SEAL MACHINE HAVING CONSTANT FILM PULL LENGTH

[75] Inventor: Dale M. Cherney, Howards Grove, Wis.

[73] Assignee: Hayssen, Inc., Duncan, S.C.

[21] Appl. No.: 09/252,496

[22] Filed: Feb. 18, 1999

[51] Int. Cl.[7] ..... B65B 9/20; B65B 57/04

[52] U.S. Cl. ..... 53/450; 53/64

[58] Field of Search ..... 53/64, 450, 451, 53/550, 551

[56] References Cited

U.S. PATENT DOCUMENTS

| | | | |
|---|---|---|---|
| 4,288,965 | 9/1981 | James | 53/451 |
| 5,318,815 | 6/1994 | Groschen, Jr. | 53/550 |
| 5,377,474 | 1/1995 | Kovacs et al. | 53/64 |
| 5,533,322 | 7/1996 | Bacon et al. | 53/451 |

*Primary Examiner*—John Sipos
*Attorney, Agent, or Firm*—Lee, Mann, Smith, McWilliams, Sweeney & Ohlson

[57] ABSTRACT

A method and apparatus for a vertical form, fill and seal machine to produce a constant pull length of the film and therefore packages of consistent length, whatever the velocity of the machine. When the film is pulled, and the pulling ceases, there is always a finite overrun of pulled film. The method according to the invention determines the velocity for operation of the machine while accounting for the overrun in order to produce packages of constant length. The apparatus includes a motion controller for calculating the velocity and operating the machine at the calculated velocity during the time that the film is being advanced in the vertical form, fill and seal machine.

11 Claims, 5 Drawing Sheets

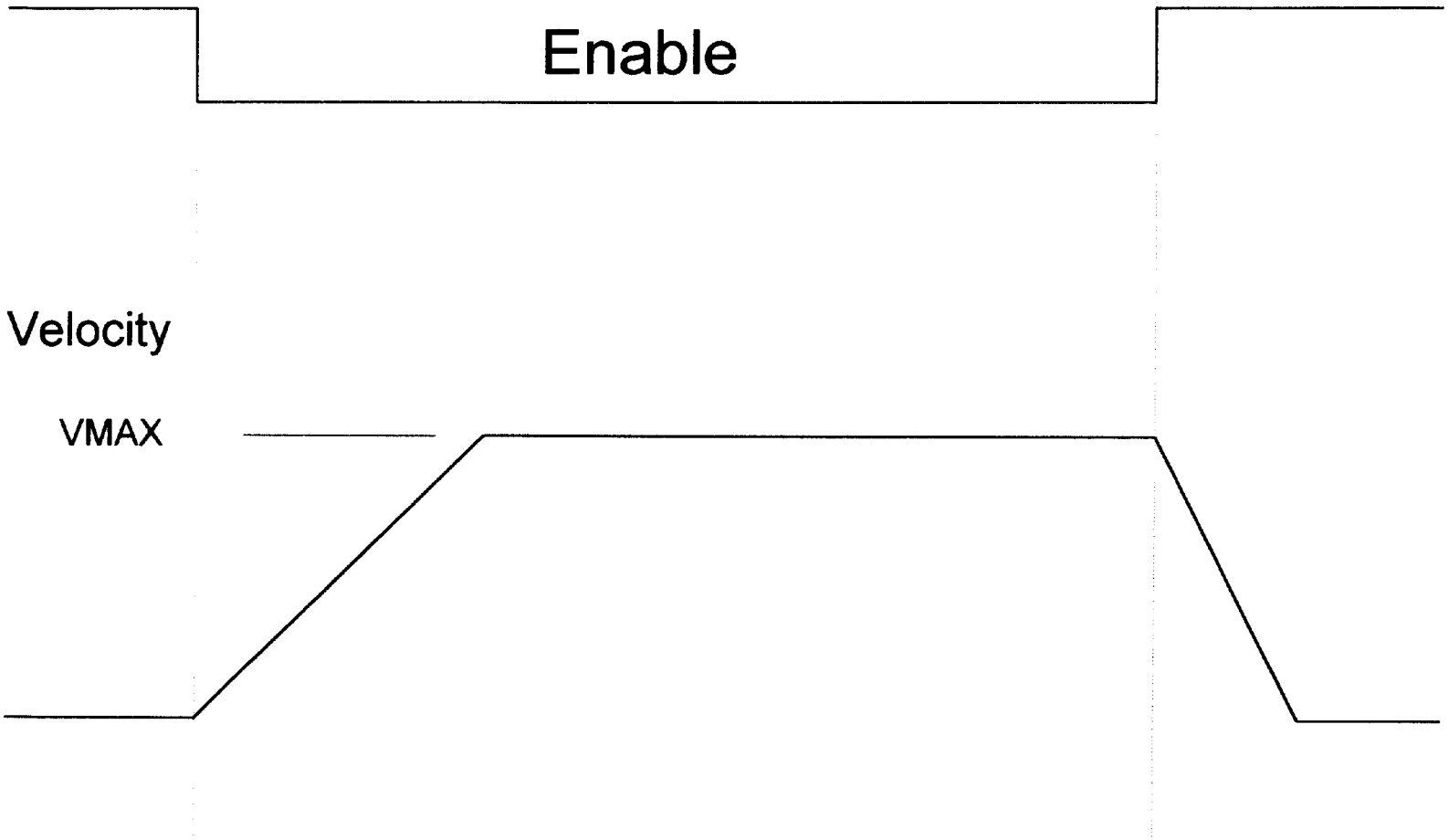
FIG. #1

FIG. #2
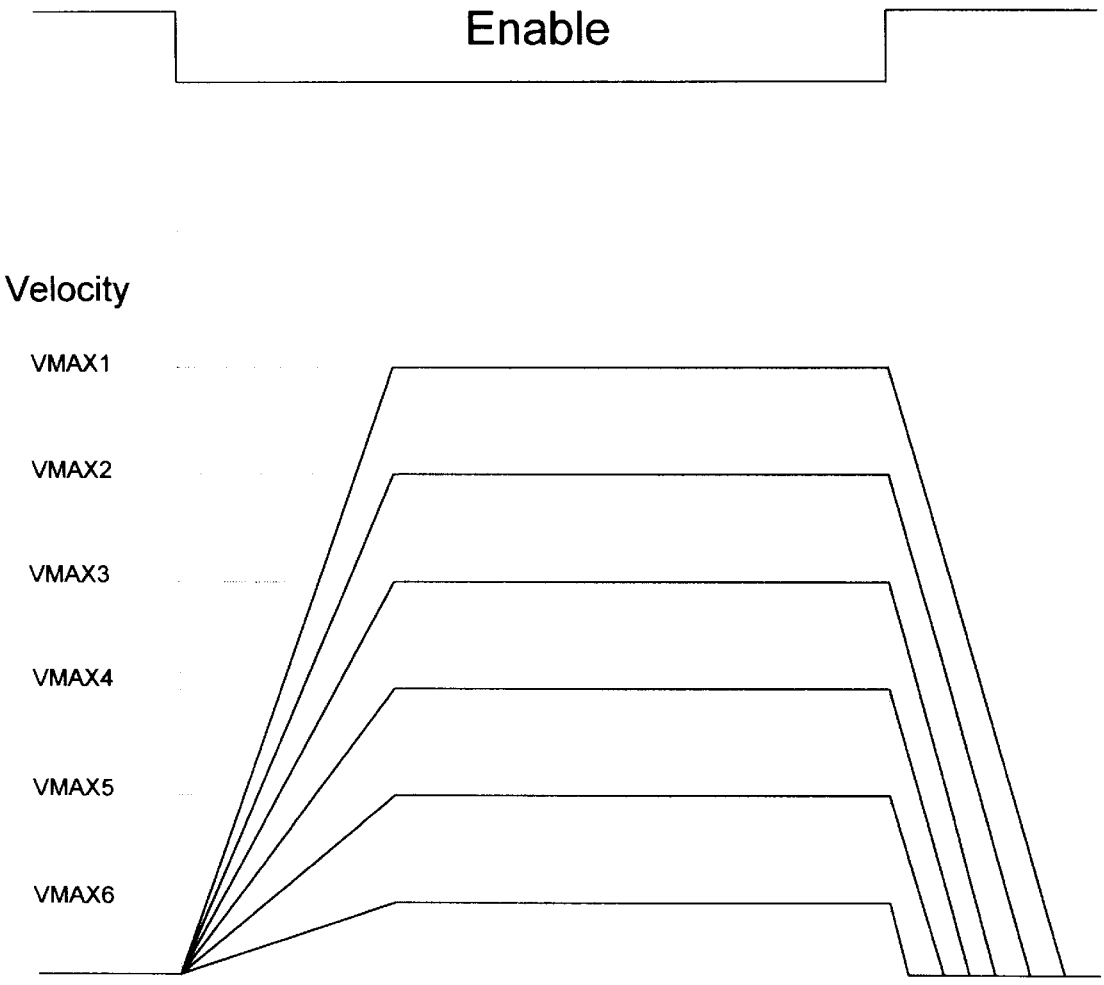

FIG. #3
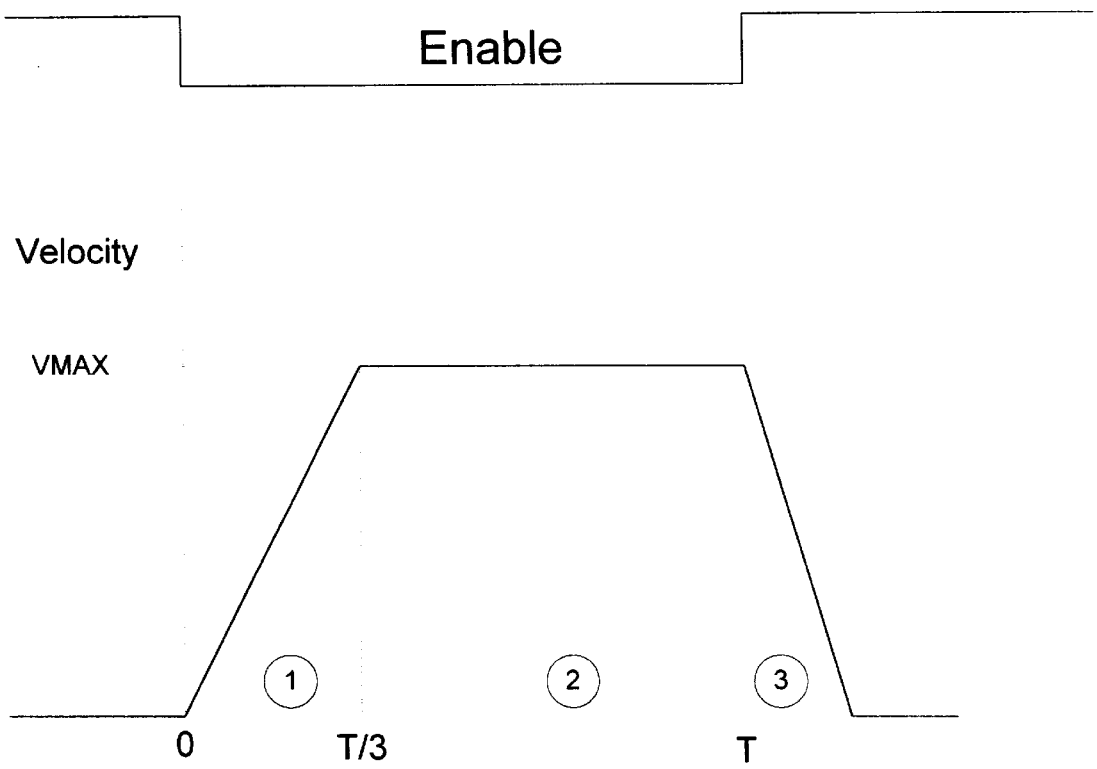

FIG. #4
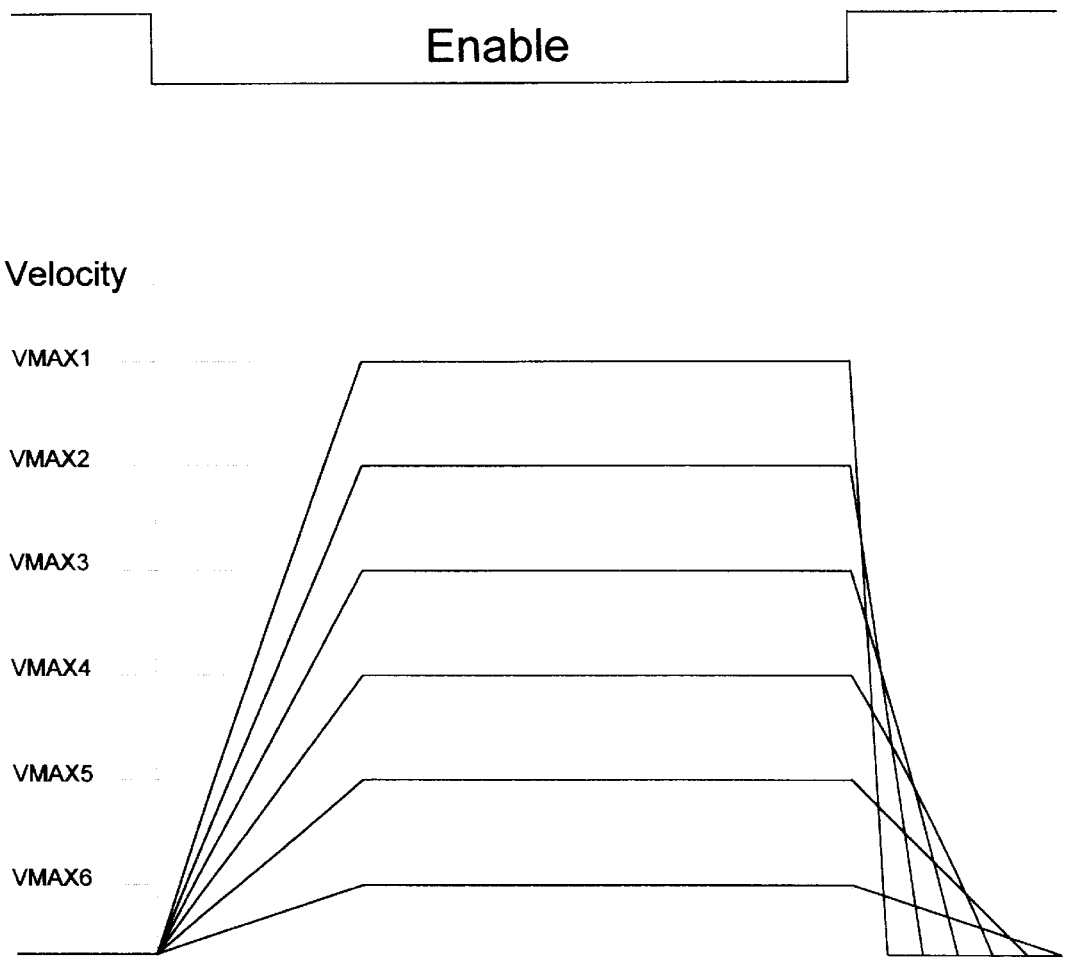

Fig. #5
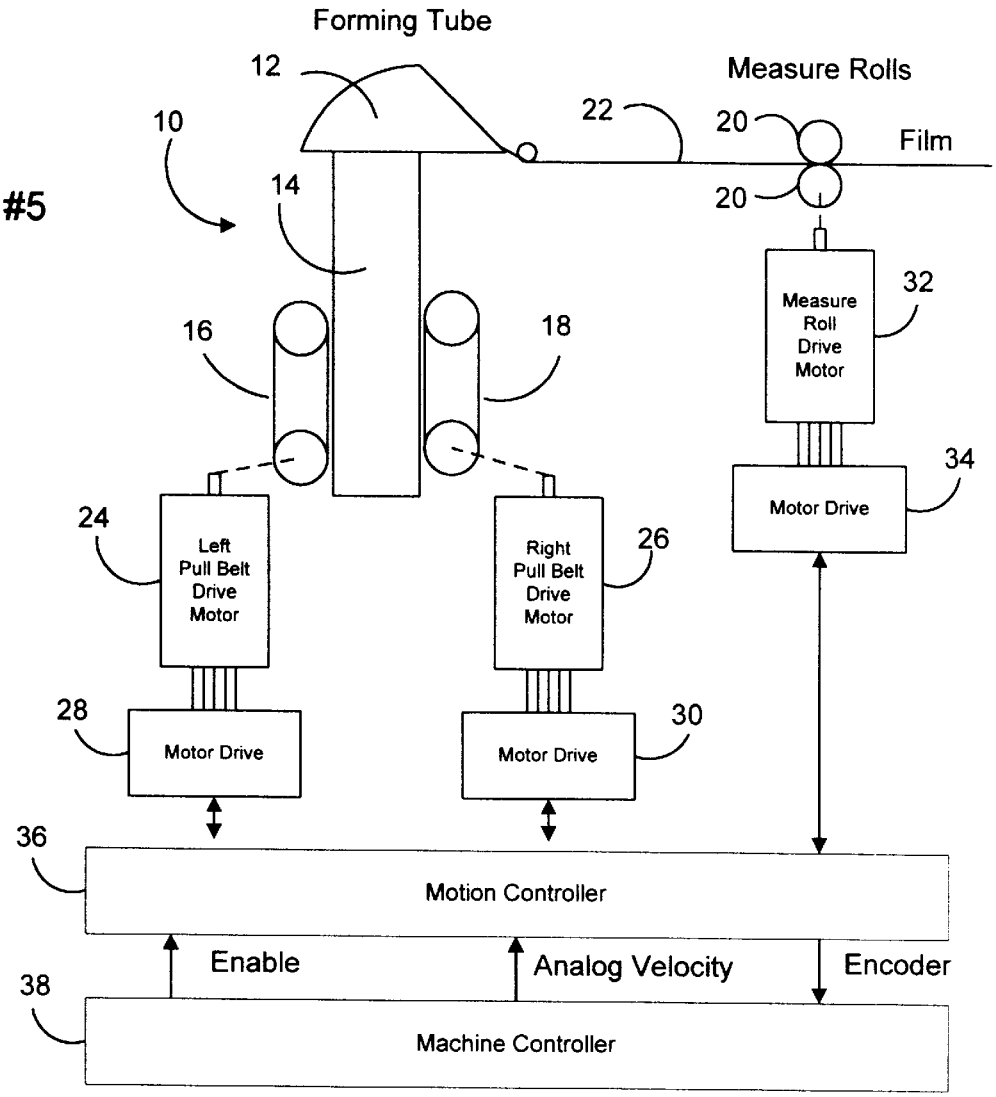

VERTICAL FORM, FILL AND SEAL MACHINE HAVING CONSTANT FILM PULL LENGTH

BACKGROUND OF THE INVENTION

This invention relates to vertical form, fill and seal machines, and in particular to a vertical form, fill and seal machine and method of operating the machine in which variations in the velocity of the film fed through the machine do not unintentionally vary the lengths of the packages being made by the machine.

For many years, manufacturers of vertical form, fill and seal machines have constructed the machinery with a series of clutches and brakes for operating the interlinked portions of the machine. One such machine is described in U.S. Pat. No. 4,288,965 assigned to Hayssen Manufacturing Company, the disclosure of which is incorporated herein by reference. The '965 patent describes a vertical form, fill and seal machine which uses a measuring roll to meter the delivery of film to the machine to produce constant length packages. The particular system described in the patent uses a clutch and brake drive system in conjunction with a shaft encoder to operate the measuring rolls within a fixed portion of a 360° bag making cycle.

The system of the '965 patent operates well when the machine is operated at a single delivery velocity for the film. However, when the speed of the film is changed, the number of degrees required to produce a package of a desired length must be changed, as well, in order to achieve that length. This is necessary because even though the measuring rolls are commanded to operate for the duration of a commanded pull signal, once the signal has ceased, the inertia of the measuring rolls causes an over-running situation. As the velocity of the rolls increases, the over-running situation worsens. While a modification of the commanded pull signal resolves the variation in package length, it is impossible to vary the velocity over a wide range without readjusting the commanded parameters for the machine. As a result, the machine, when operating with a clutch and brake drive system, normally is not utilized in situations where varying velocities occur.

However, with the advent of motion control systems, it is now possible to utilize mathematical relationships within the motion controllers used in such systems to automatically compensate for length variations that would otherwise occur due to inertia of the measuring rolls. Thus, it is now possible to accurately compensate for deceleration of the measuring rolls, which occurs outside the commanded pull signal, in order to produce packages of consistent length, without utilizing a shaft encoder or the like on the measuring rolls in order to determine the position of the rolls, and therefore the amount of film pulled.

In a typical vertical form, fill and seal machine of the nature of the invention, the portion of the 360° bag making cycle in which the measuring rolls are operated has three phases, an acceleration phase where the speed of the film is accelerated from rest to a desired maximum or running velocity, a running velocity phase where the rolls are operated at a constant velocity, and a deceleration phase, where, after the commanded pull signal has ceased, the measuring rolls are decelerated to rest. In a typical machine, the example of which is utilized in connection with the present invention, the acceleration phase occupies one third of the time of the commanded pull signal, and the running velocity phase occupies the remaining portion, or two thirds, of the commanded pull signal. It is only the deceleration phase that will vary. If there is a constant deceleration, then the amount of over-pull will vary depending on the velocity from which the measuring rolls are halted. On the other hand, the deceleration can be variable, and, in that instance, the deceleration distance always remains the same. Therefore, the time of the deceleration will vary inversely to the value of the velocity from which the measuring rolls are halted.

SUMMARY OF THE INVENTION

The invention is directed to a method and apparatus for providing consistent package lengths, irrespective of the rate of making the bags and therefore irrespective of the velocity of the measuring rolls. In accordance with the method of the invention, the method determines a running velocity for the film in a packaging machine. The method comprises the steps of determining a desired length of packages to be made by the packing machine, then determining a film velocity profile which comprises an acceleration phase for the film, a running phase for the film, and a deceleration phase for the film. Thereafter, based upon the film velocity, the method determines a film pull distance for that velocity profile, and the film pull distance is then equated to the desired length of the packages to be made by the machine, and the running velocity is calculated therefrom. Finally, the packaging machine is set with the running velocity for the film to be that of the calculated running velocity.

In accordance with one form of the invention, the acceleration phase has a constant rate of acceleration for any given running velocity, the deceleration phase has a constant rate of deceleration, and the acceleration phase and a the running velocity phase are operated for a fixed period of time, which is the duration of the commanded pull signal. Therefore, the film pull distance comprises a total of the distance traveled during the constant acceleration phase, the distance traveled in the running velocity phase, and the distance traveled in the deceleration phase. With the time for the acceleration phase being a predetermined amount (such as one third of the fixed period of time), the velocity of the running velocity phase can be calculated from the quadratic equation.

In accordance with a second form of the invention, the acceleration phase has a constant rate acceleration for any given running velocity, the deceleration phase has a fixed distance to be traveled, and the acceleration phase and the running velocity phase are operated for the fixed period of time comprising the commanded pull signal. In this instance, the velocity of the running velocity phase is calculated from a simple linear equation.

The packaging machine according to the invention includes means for providing a signal indicative of package making rate, and means for providing a signal indicative of the fixed period of time for advancing the film, with the fixed period of time encompassing the durations of the acceleration phase and the running velocity phase. Means is provided for calculating the running velocity, and means is provided for advancing the film at the running velocity.

In accordance with the preferred form of the invention, a machine controller is utilized, the machine controller encompassing both the means for providing a signal indicative of package making rate and the means for providing a signal indicative of a fixed period of time for advancing the film. The invention also preferably includes a motion controller, with the motion controller comprising the calculating means. The motion controller is connected between the machine controller and the means for advancing the film at the running velocity.

In one form, the deceleration phase includes a fixed rate of deceleration and a variable distance of film travel during the deceleration phase. In another form, the deceleration phase includes a variable rate of deceleration and a fixed distance of film travel during the deceleration phase.

In either form of the invention, the running velocity for the film is dependent on the distance traveled by the film during the deceleration phase, after cessation of the commanded film pull signal. In either form, the running velocity for the film is accurately determined so that the film pull distance is extremely accurate and the lengths of the packages made by the packaging machine are always consistent.

BRIEF DESCRIPTION OF THE DRAWINGS

The invention is described in greater detail in the following description of examples embodying the best mode of the invention, taken in conjunction with the drawing figures, in which:

FIG. 1 illustrates a traditional film pull profile of a vertical form, fill and seal machine according to the invention in relation to the enable signal for the measuring roll, FIG. 2 is a view similar to FIG. 1, but showing the effect of changing the running velocity such that the deceleration time, and consequently distance, varies, FIG. 3 is a view similar to FIG. 1, showing the three segments of each film pull cycle, with acceleration occupying one third of the enabling time and with the deceleration being constant, FIG. 4 is a view similar to FIG. 2, but with a constant deceleration distance and therefore a varying deceleration amplitude, and FIG. 5 is a block diagram of an apparatus according to the invention, including the machine controller and motion controller utilized to operate the measuring roll and pull belt axis of a vertical form, fill and seal machine.

DESCRIPTION OF EXAMPLES EMBODYING THE BEST MODE OF THE INVENTION

Turning to FIG. 1, illustrated is a typical profile for a vertical form, fill and seal machine which operates with intermittent film pull. Before an enable signal is generated, the film is at rest. When the enable signal is generated to initiate the pull cycle, the pull begins. In the illustrated form of the invention, the enable signal goes low to initiate the pull cycle and then goes high to stop the pull cycle. Obviously, the opposite could also occur, depending on the nature of the motion controller, as described in greater detail below.

When the enable signal goes low, the film is accelerated at a constant rate of acceleration until it reaches a running velocity, identified as VMAX in FIG. 1. Then, for the duration of the enable signal, the film is pulled at VMAX, and when the enable signal is terminated, pulling of the film is terminated. However, the measuring rolls have mass and corresponding inertia, and therefore cannot be decelerated instantaneously. Instead, there is a finite period of deceleration, until the film actually ceases movement. The cessation is either due to a constant deceleration, no matter what VMAX may have been, therefore producing a variable over-pull of film, or by a variable deceleration, which produces a constant length of film regardless of VMAX. Variable deceleration, however, produces longer pull times at lower values of VMAX, which is generally not acceptable, but can be used in machines needing only slow cycle operations.

Turning to FIG. 2, illustrated for the form of the invention having constant deceleration is the change of the curves for varying values of VMAX. In each, the constant rate of acceleration to reach VMAX increases as VMAX increases so that the time of reaching VMAX is always the same. However, when the enable signal goes high, the deceleration is constant, but the deceleration distances increase as VMAX increases. While a constant rate of acceleration is illustrated and preferred for reaching VMAX, obviously the rate of acceleration can vary, so long as VMAX is reached at the prescribed time.

The length of the film pulled is equal to the area under the velocity curve. This is readily seen from the following relationships:

$$\text{Time to Decelerate}=\text{VMAX}/\text{DECEL}$$

where VMAX is the constant or running velocity

DECEL is the deceleration rate.

Also, $$D_D=\tfrac{1}{2}(\text{VMAX})\cdot\text{Time to Decelerate}$$

where $D_D$ is the deceleration distance.

Thus, $$D_D=(\tfrac{1}{2})(\text{VMAX})^2/\text{DECEL}.$$

Thus, the deceleration distance varies as the square of VMAX, and therefore the over pull varies in relation to the square of VMAX, as well. This is exactly the problem which occurs in current vertical form, fill and seal machinery, and in the past, in order to accommodate for the increasing over pull as VMAX increases, the duration of the enable signal must be shortened accordingly. This, however, is disadvantageous since the most efficient operation of the machine is to have a constant duration enable signal, therefore having a fixed duration of the 360° bag making cycle.

Turning to FIG. 3, illustrated is a curve similar to that illustrated in FIG. 1, but where the acceleration to VMAX occupies one-third of the total commanded pull signal. Therefore, the running velocity or constant velocity phase occupies two-thirds of the cycle, followed by the deceleration phase. The acceleration phase of the cycle is illustrated as a linear acceleration from zero velocity to VMAX in ⅓ of the total enable signal. The percentage of cycle time and the acceleration profile can be modified as required so long as the velocity transitions from zero to VMAX in the allotted time. The calculations must obviously be modified to reflect the change in film pull which occurs during the acceleration phase in the allotted time with the selected profile.

The length or distance that the film is pulled is equal to the area under the velocity curve. Thus, for each of the three segments:

$$D_A=(\tfrac{1}{2})(\text{VMAX})T/3=(\tfrac{1}{6})(T)(\text{VMAX})$$

where $D_A$ is the acceleration distance, $$D_R=\text{VMAX}(2T/3)=(\tfrac{2}{3})(T)(\text{VMAX})$$

where $D_R$ is the distance traveled in the running velocity or constant velocity phase, and $$D_D=(\tfrac{1}{2})(\text{VMAX})^2/\text{DECEL}.$$

Therefore, the total film pull distance, $D_{TP}$, is $$D_{TP}=(1/6)(T)(VMAX)+(2/3)(T)(VMAX)+(1/2)(VMAX)^2/DECEL.$$

or, $$D_{TP}=(5/6)(T)(VMAX)+(1/2)(VMAX)^2/DECEL.$$

At this point, there are two unknowns, the total distance $D_{TP}$ and VMAX. $D_{TP}$ can be calculated utilizing parameters from the vertical form, fill and seal machine. This is accomplished by first determining the pull time. The pull time commences at the initiation of the enable signal until the pull is terminated when the enable signal goes high. This time represents a portion of the bag making cycle. If the pull time is 120 milliseconds (0.120 seconds), the pull per degree is 0.1 inch per degree and the bag making rate is 80 bags per minute, then the following relationships are true when the acceleration time is one-third of the enable cycle:

80 bags/min•360° /bag=28800° /min=480° /sec

480° /sec is 0.0020833 sec/degree.

Thus, for a 0.120 sec. pull time, 0.120 sec•480° /sec=58°.

58° @ 0.1 inch/degree=5.8 inches.

Therefore, the bag length is 5.8 inches.

The number of revolutions for the measuring roll, per bag, is bag length/roll circumference=5.8/6.25=0.928 revolutions for a measuring roll of 6.25 inches in circumference. If the measuring roll is operated with 25400 counts per revolution, then 0.928 revolution=23572 counts. These counts must be delivered in the allotted 0.120 sec. pull time.

Since the deceleration rate is constant, and taking the deceleration rate DECEL to be 6 million counts per second per second, VMAX can be determined utilizing the information above and the quadratic formula:

$$D_{TP}=(5/6)(T)(VMAX)+(1/2)(VMAX)^2/DECEL$$

or $$(1/2)(VMAX)^2/DECEL+(5T/6)(VMAX)-D_{TP}=0$$

Using the quadratic formula, $$VMAX=(-B+(B^2-4AC)^{1/2})/2A$$

where A=½• DECEL

B=5T/6

$C=D_{TP}$ then, using the values calculated above,

VMAX=201,787 Counts/sec.

For 6,000,000 counts/sec/sec deceleration rate,

Time to Decelerate=201,788 counts/sec÷6,000,00 counts/sec $^2$=0.033 seconds.

Thus, VMAX can readily be calculated in the software for the motion controller, and the vertical form, fill and seal machine can be controlled to always generate packages having a consistent bag length.

A similar analysis applies to the situation where the deceleration distance is fixed, and therefore the rate of deceleration increases or decreases depending on whether VMAX increases or decreases. Given the example above, if the maximum rate of deceleration is 6,000,000 counts per second with the highest VMAX being 300,000 counts per second, the distance traveled during deceleration would be 7,500 counts, and would take 0.05 seconds. FIG. 4 illustrates this form of the invention where VMAX varies from a maximum value to a minimum value, and it can be seen that as VMAX varies, the deceleration time becomes excessively slow. To calculate VMAX in this form of the invention, and given the values explained above, $$D_{TP}=D_A+D_R+D_D$$

$$=(5/6)(T)(VMAX)+(2/3)(T)(VMAX)+D_D$$

$$=(5/6)(T)(VMAX)+D_D$$

or $$(5/6)(0.120)(VMAX)=23572-7500$$

$$VMAX=160,874 \text{ counts/sec}$$

and

Time to Decelerate=0.0933 sec.

Thus, it will be seen that although, in this form of the invention, the maximum velocity is slightly slower than in the first form of the invention, the deceleration time is three times longer than in the first form of the invention. Therefore, in most instances, a constant rate of deceleration analysis provides quicker completion of the film pull, leaving more time for subsequent action (sealing and severing) for each 360° bag making cycle.

FIG. 5 illustrates a typical machine configuration according to the invention. In FIG. 5, the vertical form, fill and seal machine is designated generally at 10. It includes a forming shoulder 12, a forming tube 14, and a pair of pull belts 16 and 18. A pair of measuring rolls 20 are located upstream of the forming tube 12 for feeding film 22 through the machine 10.

Each of the pull belts 16 and 18 is driven by a respective servo drive motor 24 and 26, each motor 24 and 26 having its associated motor drive 28 and 30. It is important, for proper pulling of the film 22, that the pull belts 16 and 18 operate at exactly the same speeds, and therefore the drive motors 24 and 26 are typically driven in parallel.

Similarly, the measuring rolls 20 are driven by a servo drive motor 32 controlled by a motor drive 34. No shaft encoders or the like are needed for either the measuring rolls 20 or the pull belts 16 and 18.

The motor drives 28, 30 and 34 are connected to a motion controller 36. The motion controller can be any conventional motion controller, and for the purposes of the examples above, the Galil model DMC-1530 motion controller manufactured by Galil Motion Control Incorporated, 203 Ravendale Drive, Mountainview, Calif., 94043, was used. The motion controller 36, in turn, receives signals from a conventional machine controller 38, such as the programmable control described in incorporated U.S. Pat. No. 4,288,965.

The machine controller 38 generates the enable signal (FIGS. 1 through 4) as well as an analog signal which represents the number of packages per minute on an analog scale. The third signal, an encoder emulation signal, is fed to the machine controller 38 from the motion controller 36.

During operation of the machine 10, the measuring rolls 20 comprise one axis, and the pull belts 16 and 18 comprise a second axis. The measuring roll axis is the master, and the pull belt axis is the slave. When the film 22 is pulled by the pull belts 16 and 18, it is metered by the measuring rolls 20. If the measuring rolls have a diameter of 2.5 inches and the pull belts have sheaves of a 3.75 inch diameter, then, if the motion of the measuring rolls 20 and the pull belts 16, 18 are exactly matched, one revolution of the measuring rolls is 7.854 inches, and one revolution of the pull belt sheaves is 11.781 inches. Therefore, the ratio of the measuring roll axis to the pull belt axis is 7.854/11.781=0.6667. Thus, for exact matching of speed between the master axis and the slave axis, the pull belts must be operated at a rate of 0.6667 times the speed of the measuring roll axis, assuming that the rolls of the measuring roll axis are driven directly from the motor. While this is an ideal situation, typically the surfaces of the pull belts 16 and 18 wear, leading to slight slip between the pull belts 16, 18 and the film tube over the tube 14. To overcome the slippage, the pull belts 16 and 18 are driven an additional over-pull percentage, up to 10 percent greater than the direct match. This avoids any slacking of the film between the measuring rolls 20 and the pull belts 16, 18. Tension is maintained in the film 22, and the pull belts 16, 18 slip slightly before the film 22 is torn.

The invention provides a simple, yet effective, manner to operate a vertical form, fill and seal machine with exact bag lengths by precisely controlling VMAX. Various changes can be made to the invention without departing from the spirit thereof, or scope of the following claims.

What is claimed is:

1. A method determining a running velocity for film in a packaging machine, comprising the steps of:

a. determining a desired length of packages to be made by the packaging machine, b. determining a film velocity profile comprising an acceleration phase for the film, a running velocity phase for the film and a deceleration phase for the film, c. determining a film pull distance from the film velocity profile, d. equating the film pull distance to the desired length, and calculating the running velocity therefrom, and e. setting in the packaging machine the running velocity for the film from the calculated running velocity.

2. The method according to claim 1 in which the acceleration phase is for a predetermined period of time, the deceleration phase has a constant rate of deceleration, and the acceleration phase and the running velocity phase are operated for a fixed period of time.

3. The method according to claim 2 in which the acceleration phase has a constant rate of acceleration which is varied for each different running velocity.

4. The method according to claim 2 in which the pull distance comprises:

$$D_{TP}=D_A+D_R+D_D$$

where $D_{TP}$ is film pull distance $D_A$ is distance traveled in the acceleration phase $D_R$ is the distance traveled in the running velocity phase $D_D$ is the distance traveled in the deceleration phase.

5. The method according to claim 4 in which:

$$D_D=\tfrac{1}{2}(VMAX)^2/DECEL$$

where VMAX is the running velocity

DECEL is the deceleration rate in the deceleration phase, and $D_R=(VMAX)T_R$ where $T_R$ is the time period for the running velocity phase, and $D_A=\tfrac{1}{2}(VMAX)T_A$ where $T_A$ is the time period for the acceleration phase, and $T=T_A+T_R$ where T is the fixed period of time.

6. The method according to claim 4 in which $T_A$ is ⅓ T, and $$D_{TP}=\tfrac{5}{6}(VMAX)T+\tfrac{1}{2}(VMAX)^2/DECEL.$$

7. The method according to claim 1 in which the acceleration phase is for a predetermined period of time, the deceleration phase has a fixed distance traveled, and the acceleration phase and the running velocity phase are operated for a fixed period of time.

8. The method according to claim 7 in which the acceleration phase has a constant rate of acceleration which is varied for each different running velocity.

9. The method according to claim 7 in which the pull distance comprises:

$$D_{TP}=D_A+D_R+D_D$$

where $D_{TP}$ is film pull distance $D_A$ is distance traveled in the acceleration phase $D_R$ is the distance traveled in the running velocity phase $D_D$ is the distance traveled in the deceleration phase.

10. The method according to claim 4 in which:

$$D_R=(VMAX)T_R$$

where VMAX is the running velocity $T_R$ is the time period for the running velocity phase, and $D_A=\tfrac{1}{2}(VMAX)T_A$ where $T_A$ is the time period for the acceleration phase, and $T=T_A+T_R$ where T is the fixed period of time.

11. The method according to claim 10 in which $T_A$ is ⅓ T and, $$D_{TP}=\tfrac{5}{6}(VMAX)T+D_D$$

* * * * *